United States Patent [19]

Feiner

[11] 4,121,320

[45] Oct. 24, 1978

[54] AIR CONTROLLED GUTTER CLEANER

[76] Inventor: Alexander Feiner, 4 Sailer's Way, Rumson, N.J. 07760

[21] Appl. No.: 810,298

[22] Filed: Jun. 27, 1977

[51] Int. Cl.[2] ..... A47L 5/00

[52] U.S. Cl. ..... 15/406; 15/410

[58] Field of Search ..... 15/144 B, 236 R, 328, 15/329, 402, 405, 410, 406

[56] References Cited

U.S. PATENT DOCUMENTS

| | | | |
|---|---|---|---|
| 2,346,339 | 4/1944 | Vose | 15/350 X |
| 2,586,145 | 2/1952 | Breuer et al. | 15/405 X |
| 2,623,234 | 12/1952 | Brown | 15/410 X |
| 2,710,616 | 6/1955 | Tydings | 134/167 R |
| 2,896,239 | 7/1959 | Bugbird | 15/144 B |
| 3,041,655 | 7/1962 | Entler | 15/236 X |
| 3,751,749 | 8/1973 | Wilson | 15/23 X |

*Primary Examiner*—Christopher K. Moore

[57] ABSTRACT

An air controlled overhead gutter cleaner is disclosed having a head portion and a hollow supporting arm portion. The head is adapted for movement along the gutter under control of a person walking along the ground. The head is shaped such that as air, which is forced through the hollow support arm, exits from the head, leaves and other debris in the gutter are blown out of the gutter. A rear baffle is provided to deflect the expelled material forward and off the roof.

9 Claims, 5 Drawing Figures

AIR CONTROLLED GUTTER CLEANER

BACKGROUND OF THE INVENTION

This invention relates to an overhead gutter cleaner and, more particularly, to such a cleaner using forced air directed from the ground.

A constant problem with overhead rain gutters is their tendency to clog with leaves, dirt, sand, roofing material and unspecified other debris. Unless this foreign material is periodically removed, rainwater rolling off the roof soon fills the gutter and overflows thereby defeating the gutter's purpose entirely.

The task of cleaning a gutter is not a pleasant one and in some situations can be dangerous because of the height or because of the sloping nature of the roof or of the terrain below. In any event, a need exists in the art for an overhead gutter cleaner which allows the operator, usually a homeowner, to remove collected debris without resort to ladders and without the use of elaborate equipment.

SUMMARY OF THE INVENTION

I have found that by using forced air a person can walk along the ground holding a light-weight hollow support arm. The other end of the support arm rests on the front edge of the gutter and, in turn, supports a head portion which is maintained inside the U portion of the gutter. Air is forced through the hollow support arm and into the head. The head is shaped such that as the air exits therefrom it serves to force the foreign material upward from the base of the gutter. Once the material begins to move the air stream coming from the output nozzle of the head catches the material and forces it from the roof. In one embodiment of my invention I use a baffle behind the head to insure that the material is deflected forward and off the roof.

Thus, one feature of my invention is the provision of a forced air gutter cleaning arrangement which is light-weight, portable and easily used by a homeowner.

Another feature of my invention is the arrangement of a forced air overhead gutter cleaner having a baffle for insuring removal of foreign material from the roof.

BRIEF DESCRIPTION OF THE DRAWING

The operation, construction and utilization of my invention will be more fully apparent from the following description of the drawing, in which.

DETAILED DESCRIPTION

Figure 1:
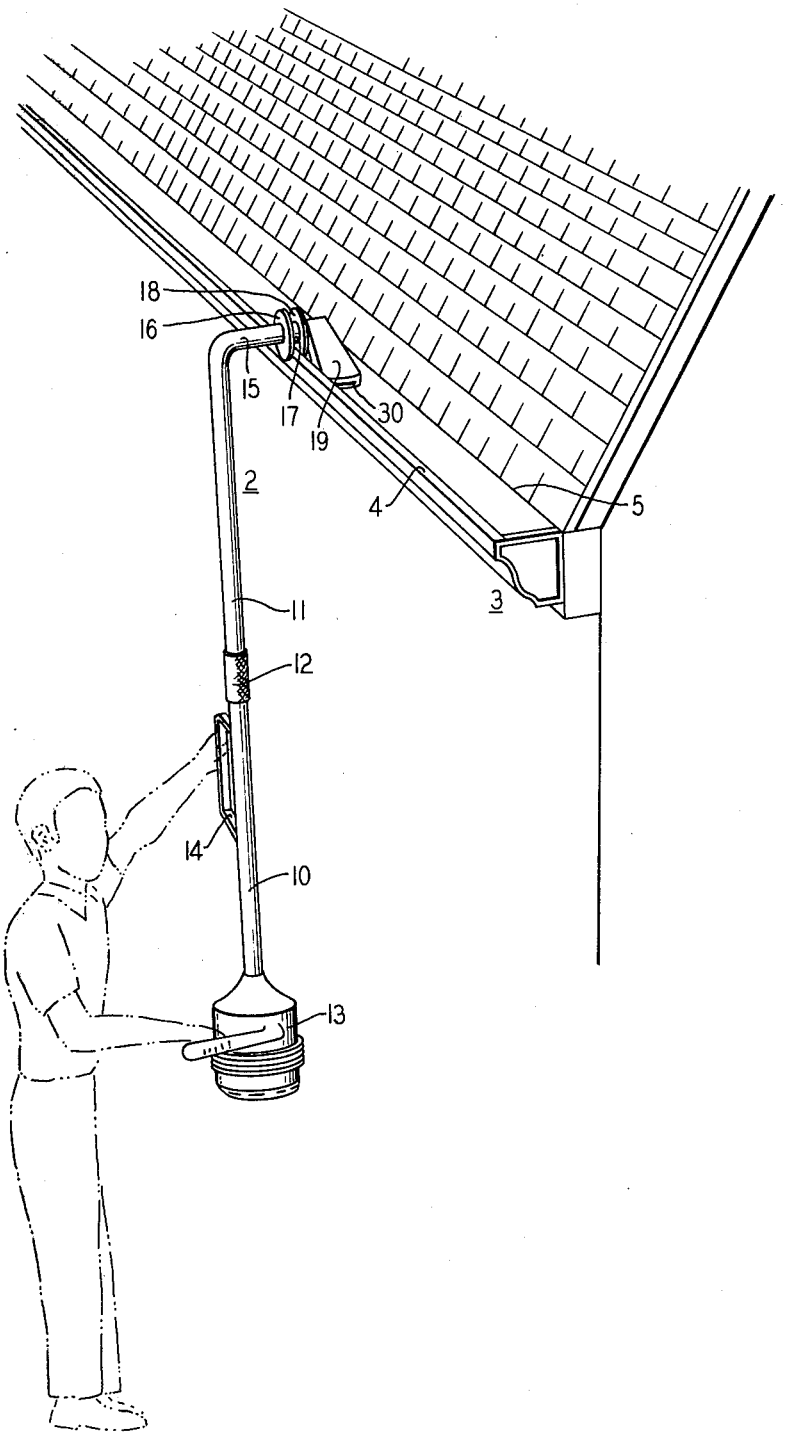
FIG. 1 shows an embodiment of my invention using a rigidly affixed forced air supply.

As shown in FIG. 1, forced air from air generator 13 is moved through hollow support arm 2 and into head 19. The air exits from head output port 30 and any debris which is in gutter 3 is expelled.

Support arm 2 is shown having air input section 10 to which handle 14 is attached. Section 10 is connected to section 11 by coupling 12 which allows for adjustment between these sections. This adjustment is in the well-known manner such that section 11 slides inside section

10. By tightening coupling 12 the two sections can be adjusted to provide different lengths. It should be noted that additional sections may be added between section 10 and 11 to adjust the overall height from the ground of head 30 to any desired distance.

Air motor 13 can be any convenient source of forced air and it would be practical to have an adjustment of the air pressure or air volume to compensate for different gutter heights, and for removing different types of material from the gutter.

Support arm section 11 is shown having a portion 15 which is substantially perpendicular to the structure, such as a house, upon which the gutter is mounted. This section rests on front edge 4 of the gutter and serves to help support the weight of support arm 2 and serves to maintain head 30 in a fixed position relative to the U opening of the gutter. This position may be above the opening or may be inside the opening.

Disks 16 and 18 mounted to section 15 serve to control the forward-backward movement of head 30. This arrangement will be discussed below in conjunction with FIG. 5.

Gutter 3, which may be wood, aluminum or any other material, is typically shaped as shown with a substantially U shaped profile and having a forward edge 4 and a rear edge 5. These edges extend along the length of the gutter. Disks 16 and 18 are adjusted, as will be discussed, to fit over edge 4.

Head 30 is hollow and is connectable to arm 2 and is arranged to receive air forced through arm 2. The shape of head 30 is such that the forced air exits at a point which is directed along the length of the gutter and in a direction in which the head is moving. Opening 30, as will be discussed, has a width approximately the same as the width of the U opening of the gutter.

Figure 2:
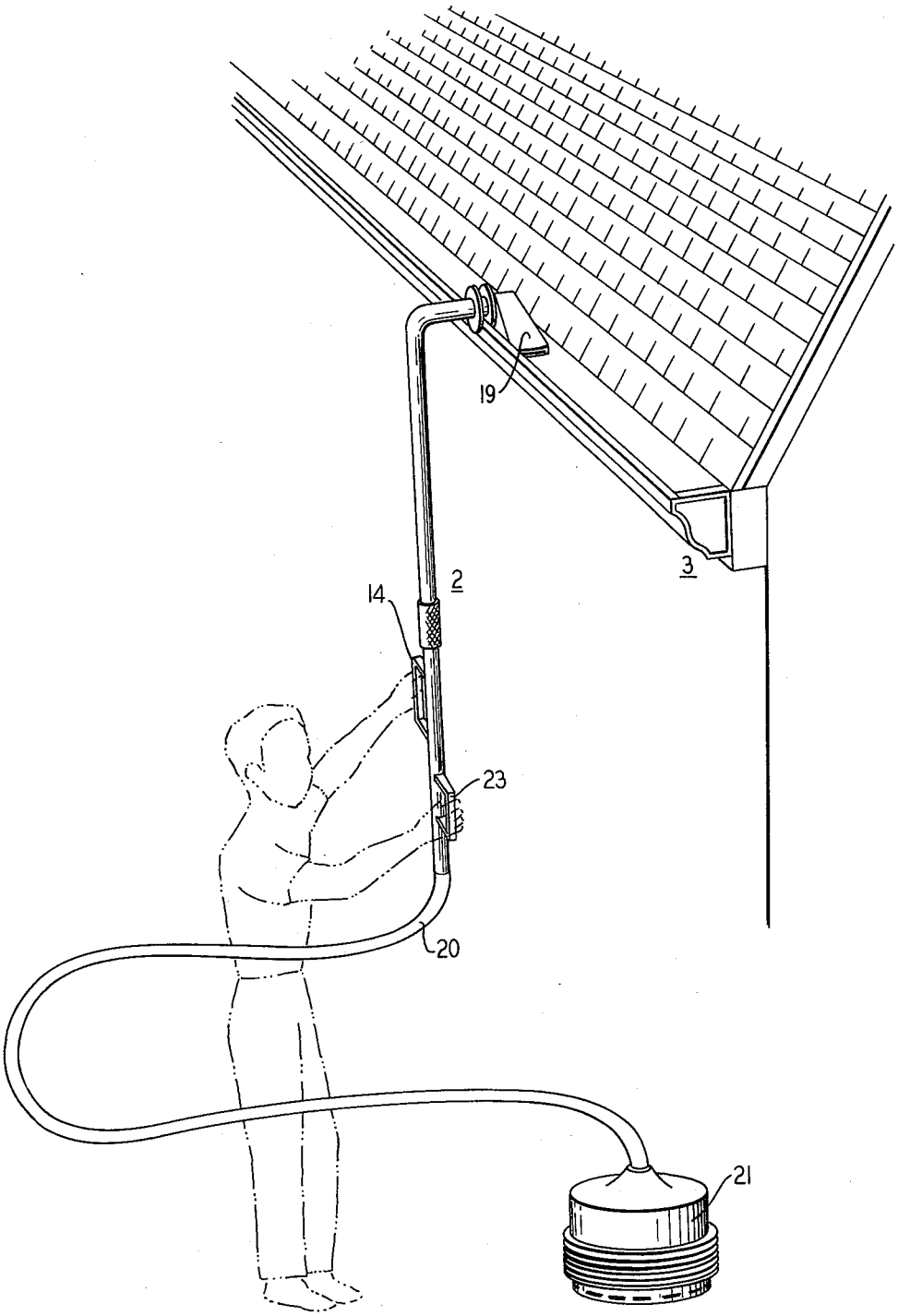
FIG. 2 shows another embodiment of my invention using a flexibly coupled forced air supply.

FIG. 2 shows a forced air source 21 which is flexibly coupled by air hose 20 with the air inlet end of arm 2. The advantage of this arrangement is its lighter weight and the ability to use a more powerful air source. This source, as well as source 13, can either be electrically powered or can be powered by gasoline, oil or any other source. In addition, as a further economy factor, the air source can be a vacuum sweeper operated in reverse.

Figure 3:
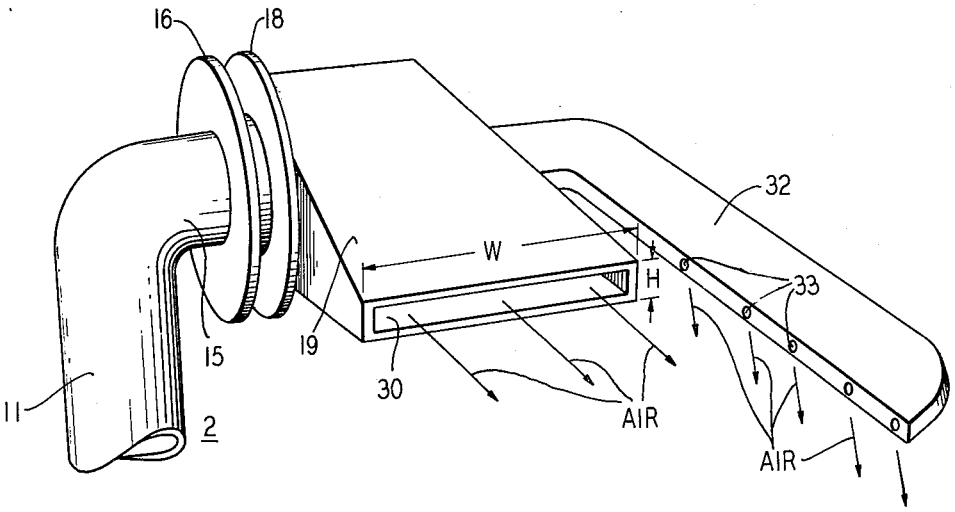
FIG. 3 shows an embodiment of my invention using a baffle having forward air movement.

In FIG. 3 there is shown disks 16 and 18 which are attached to arm 2. Head 30 is shown having air output port 30 having a width $w$ and height $h$. The width is determined by the width of a standard gutter, while the height can be determined by the air force desired. Air baffle 32 is hollow with air outlets 33 spaced along one edge. This arrangement allows the air to push debris down the roof so that they fall over the side and are not merely blown further up the roof. This air baffle can be attached to head 19 with a flexible coupling so as to be adaptable to the contour of the roof. The air coming from air outlets 33 blows in a radiated pattern outward from baffle 32 to interact with the air exiting from opening 30 so as to deflect material forced from the gutter away from the structure upon which the baffle is resting.

Figure 4:
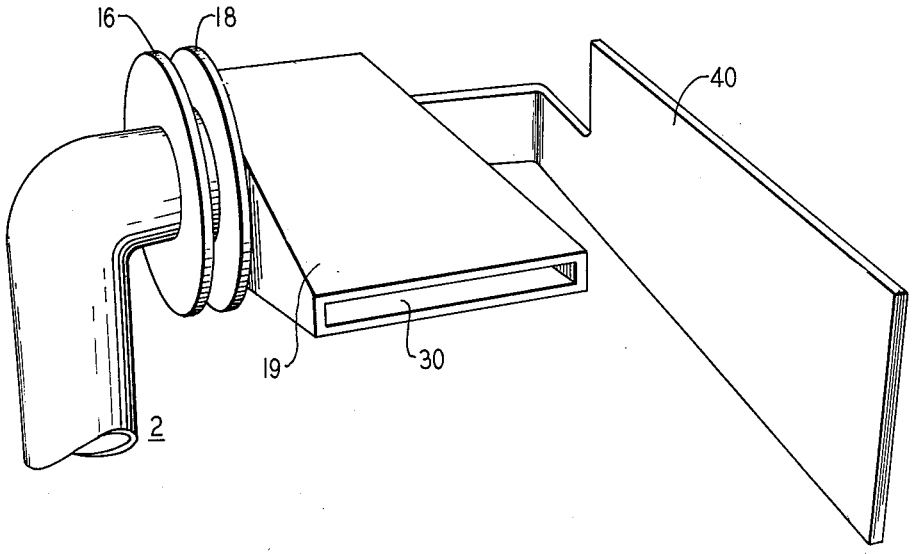
FIG. 4 shows an embodiment of my invention using a fixed plate baffle.

In FIG. 4 there is shown a solid air baffle 40 attached to head 19. Baffle 40 is arranged to mechanically deflect material forced from the gutter by air flowing from opening 30 away from the structure upon which the baffle is resting. The attachment of baffle 40 can also be by flexible coupling.

Figure 5:
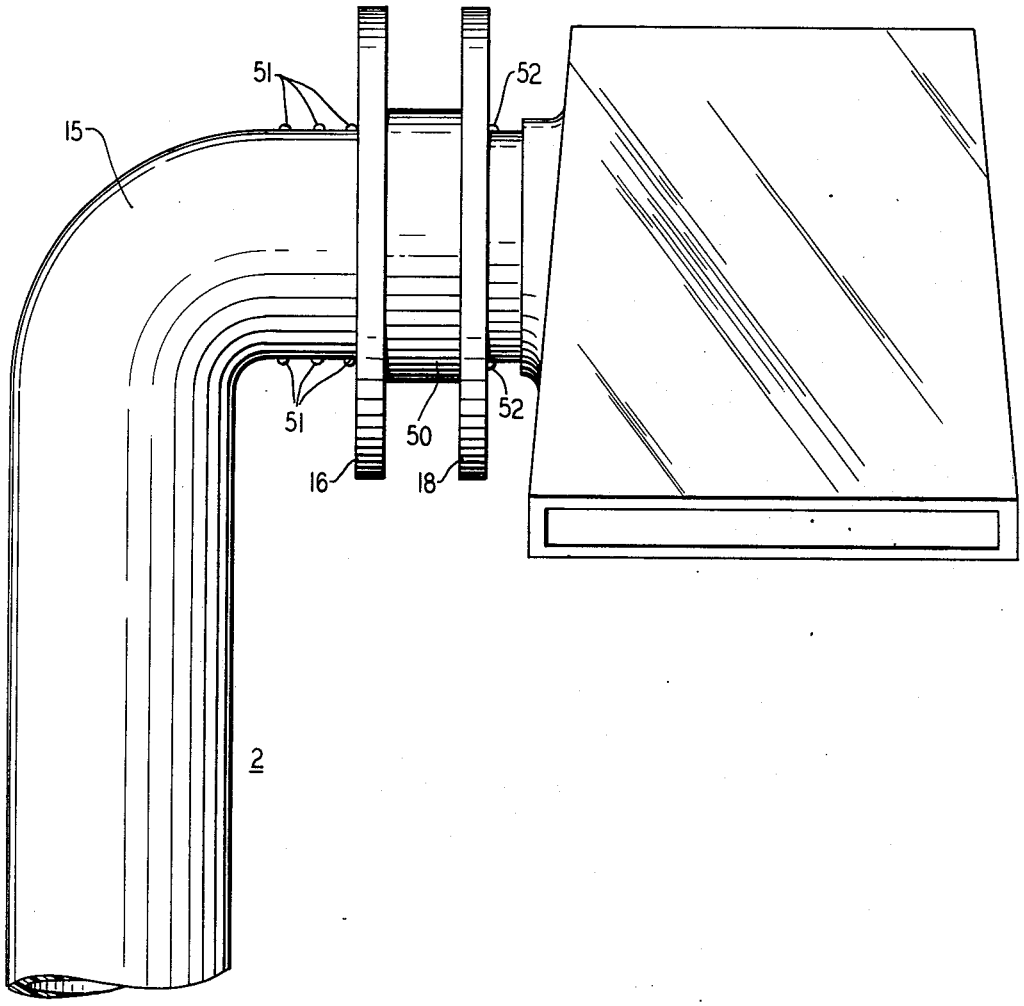
FIG. 5 shows details of the positioning structure.

FIG. 5 is a detailed view of rings 16 and 18 which are separated by sleeve 50, which sleeve is free to rotate around arm portion 15. The distance between rings 16 and 18 can be varied by using different length sleeves. It should also be noted that a sleeve is not required and the gutter lip could ride along support arm portion 15 directly. Projections 51 and 52 can be provided for positioning the rings to accommodate gutter lips having different widths. In addition, a spiral spring could be mounted around arm 15 between projection 51 and ring 16 to allow the space between rings 16 and 18 to continuously vary as the device is moved along a gutter.

What is claimed is:

1. An apparatus for cleaning a gutter affixed to an overhead structure, said gutter having front and rear edges disposed along its length and having generally a U shape with the opening of said U facing upward, said rear edge being the edge affixed nearest said structure, said cleaning apparatus comprising:

a head portion;

means for maintaining said head portion in a relatively fixed position with respect to said open portion of said gutter while still allowing said head portion to move along the length of said gutter;

a hollow support arm connected to said head portion;

means for applying forced air to an input end of said hollow support portion so that said air moves through said hollow support portion to an output end of said arm;

said head having an input port adapted for connection to said output end of said support arm and for receiving said forced air moving through said hollow portion of said arm;

said head having an output port with an opening width substantially the same as the width of said gutter and arranged to force said received air into said gutter in a direction along the length of said gutter; and a baffle connected to said head portion, said baffle connected along a side of said head portion opposite the connection of said support arm and nearest said rear edge of said gutter, said baffle arranged to deflect material forced from said gutter by said forced air movement along said gutter away from said structure.

2. The invention set forth in claim 1 wherein said baffle includes an air inlet port as a part of said connection with said head portion;

said baffle further including at least one air outlet port adapted for directing air against material forced from said gutter by said forced air movement along said gutter.

3. The invention set forth in claim 1 wherein said support arm has a first section which extends from said air inlet end upwardly in a direction generally parallel to said structure to which said gutter is affixed, and a second section which extends from said first section to said head portion, said second section being generally perpendicular to said structure when said head portion is being maintained in said relatively fixed position with respect to said open portion of said gutter.

4. The invention set forth in claim 3 wherein said maintaining means includes a pair of disks mounted concentrically around said second portion of said supporting arm, said pair of disks spaced apart a distance determined by the thickness of the front edge of said gutter.

5. The invention set forth in claim 4 wherein the space between said disks is self-adjustable to the width of said gutter front edge.

6. The invention set forth in claim 5 wherein said disks are separated by a sleeve, said sleeve adapted for rotation around said support arm and for contact with said front edge of said gutter.

7. The invention set forth in claim 1 wherein said air applying means includes an air producing motor rigidly affixed to the air inlet end of said supporting arm.

8. The invention set forth in claim 1 wherein said air applying means includes an air producing motor connected by a flexible hose to the air inlet end of said support arm.

9. The invention set forth in claim 1 wherein the length of said support arm is manually adjustable.

* * * * *